US009221152B2

(12) United States Patent
Petersen et al.

(10) Patent No.: US 9,221,152 B2
(45) Date of Patent: Dec. 29, 2015

(54) LAMINATED FLEXIBLE RESILIENT ABRASIVE ARTICLE

(75) Inventors: John G. Petersen, Center City, MN (US); Chris A. Minick, Stillwater, MN (US); Ian R. Owen, Baldwin, WI (US)

(73) Assignee: 3M Innovative Properties Company, St. Paul, MN (US)

( * ) Notice: Subject to any disclaimer, the term of this patent is extended or adjusted under 35 U.S.C. 154(b) by 1131 days.

(21) Appl. No.: 12/548,563

(22) Filed: Aug. 27, 2009

(65) Prior Publication Data

US 2010/0009604 A1 Jan. 14, 2010

Related U.S. Application Data

(62) Division of application No. 11/404,451, filed on Apr. 14, 2006, now abandoned.

(51) Int. Cl.

| | |
|---|---|
| ***B24D 11/00*** | (2006.01) |
| ***B24B 1/00*** | (2006.01) |
| ***B24D 15/04*** | (2006.01) |
| ***B24D 11/02*** | (2006.01) |

(52) U.S. Cl.

CPC ..... *B24D 15/04* (2013.01); *B24D 11/00* (2013.01); *B24D 11/02* (2013.01); *B24B 1/00* (2013.01)

(58) Field of Classification Search

CPC ..... B24D 15/04; B24D 11/02
USPC ..... 451/56–539, 514, 518
See application file for complete search history.

(56) References Cited

U.S. PATENT DOCUMENTS

| | | | | |
|---|---|---|---|---|
| 2,715,804 | A | | 8/1955 | Wickes |
| 2,899,288 | A | * | 8/1959 | Barclay ..... 51/293 |
| 3,021,649 | A | | 2/1962 | Robbins |
| 3,030,742 | A | | 4/1962 | Costello |
| 3,230,672 | A | * | 1/1966 | Anthon ..... 451/536 |
| 3,261,049 | A | | 7/1966 | Murphy |
| 3,510,992 | A | | 5/1970 | Hutchins |
| 3,973,362 | A | | 8/1976 | Groshans |
| 4,077,165 | A | | 3/1978 | Hutchins |
| 4,202,139 | A | * | 5/1980 | Hong et al. ..... 451/524 |
| 4,398,375 | A | | 8/1983 | Malyuk |
| 4,625,462 | A | | 12/1986 | Fushiya et al. |
| 4,629,473 | A | | 12/1986 | Ruid et al. |
| 4,714,644 | A | * | 12/1987 | Rich ..... 428/136 |
| 4,966,609 | A | | 10/1990 | Callinan et al. |
| 4,974,369 | A | | 12/1990 | Dixon |
| 5,109,638 | A | * | 5/1992 | Kime, Jr. ..... 451/539 |
| 5,168,672 | A | | 12/1992 | Gregoire, Sr. |
| 5,474,490 | A | | 12/1995 | Allport |
| 5,595,578 | A | | 1/1997 | Stubbs et al. |
| 5,733,178 | A | | 3/1998 | Ohishi |

(Continued)

FOREIGN PATENT DOCUMENTS

| | | |
|---|---|---|
| CN | 1238162 | 12/1999 |
| DE | 19933887 | 1/2001 |

(Continued)

*Primary Examiner* — Bryan R Muller
(74) *Attorney, Agent, or Firm* — Kenneth B. Wood

(57) ABSTRACT

A sheet-like abrasive article includes a resilient backing sheet having opposed major surfaces and a continuous abrasive sheet affixed to the backing sheet. The abrasive sheet includes an abrasive support layer with abrasive particles arranged thereon, thereby defining an abrasive surface. A sanding tool assembly including such a sheet-like abrasive article is also disclosed.

11 Claims, 3 Drawing Sheets

(56) References Cited

U.S. PATENT DOCUMENTS

| | | | | |
|---|---|---|---|---|
| 5,807,161 | A | 9/1998 | Manor et al. | |
| 5,849,051 | A | 12/1998 | Beardsley et al. | |
| 6,110,015 | A | 8/2000 | Christianson et al. | |
| 6,328,773 | B1 | 12/2001 | Beardsley | |
| 6,406,504 | B1 * | 6/2002 | Lise et al. | 51/297 |
| 6,613,113 | B2 * | 9/2003 | Minick et al. | 51/298 |
| 6,626,746 | B2 | 9/2003 | Mayr et al. | |
| 6,641,469 | B2 | 11/2003 | Deshler | |
| 6,746,974 | B1 | 6/2004 | Reiterer et al. | |
| 6,935,936 | B2 | 8/2005 | Goulet et al. | |
| 7,285,146 | B2 | 10/2007 | Petersen | |
| 7,497,768 | B2 | 3/2009 | Minick et al. | |
| 2002/0173214 | A1 * | 11/2002 | Mann et al. | 442/417 |
| 2003/0104777 | A1 | 6/2003 | Deshler | |
| 2003/0119437 | A1 * | 6/2003 | Rich et al. | 451/529 |
| 2003/0121212 | A1 | 7/2003 | Minick | |
| 2006/0189266 | A1 * | 8/2006 | Anderson | 451/296 |
| 2006/0246830 | A1 | 11/2006 | Kirschhoffer et al. | |

FOREIGN PATENT DOCUMENTS

| | | | |
|---|---|---|---|
| JP | 9-141547 | A | 6/1997 |
| WO | WO 02/084004 | | 10/2002 |
| WO | WO 2004/091855 | A3 | 10/2004 |

* cited by examiner

LAMINATED FLEXIBLE RESILIENT ABRASIVE ARTICLE

CROSS REFERENCE TO RELATED APPLICATIONS

This application is a divisional of U.S. patent application Ser. No. 11/404,451, filed Apr. 14, 2006, now abandoned the disclosure of which is herein incorporated by reference.

BACKGROUND

The present invention relates generally to sheet-like abrasive articles used for abrading a work surface and, more particularly, to flexible resilient sheet-like abrasive articles, and to a sanding tool assembly including such an abrasive article.

Sheet-like abrasive articles are commonly used in a variety of sanding operations including hand sanding of wooden surfaces. In hand sanding, the user may hold the abrasive article directly in his or her hand and move the abrasive article across the work surface. Sanding by hand can, of course, be an arduous task.

To facilitate the hand sanding process, the sheet-like abrasive article may be placed on a sanding block. Sanding blocks hold the abrasive article and can be readily grasped by a user to make hand sanding faster and easier. A commercially available sanding block is the 3M™ Rubber Sanding Block available from 3M Company, St. Paul, Minn. Sanding blocks are also known in the patented prior art. U.S. Pat. No. 5,168,672, (Gregoire, Sr.) for example, discloses an abrasive sheet holder having a base provided with clamping shoulders formed in a pair of opposed side edges thereof. A handle member is detachably secured over a rear surface of the base. The handle member has opposed flexible flange walls for clamping opposed end edge portions of an abrasive paper sheet which is positioned over a front working surface of the base with the edge portions of the paper sheet extending over the clamping shoulders.

U.S. Pat. No. 6,641,469 (Deshler) discloses a sanding block including a generally rectangular base housing upon which a multiply contoured generally convex hand grip is secured. The hand grip further defines inwardly extending concave portions that facilitate easy and secure grip by the user. An over-center lever clamp mechanism is operative at each end of the sanding block to secure the opposed ends of a sandpaper sheet in a releasable attachment.

U.S. Pat. No. 6,935,936 (Goulet et al.) discloses a hand held abrading tool including clamping mechanisms to quickly and reliably secure sanding paper, bristled sheets, polishing cloths, and the like to the tool.

Sheet-like abrasive articles include, for example, conventional sandpaper. Conventional sandpaper is typically produced by affixing abrasive mineral to a relatively thin, non-extensible, non-resilient, and optionally non-porous backing material, such as paper or a polymeric film material. Conventional sandpaper typically exhibits good initial stock removal (i.e. cut) but produces a relatively deep scratch pattern for a given mineral size, and generally has an undesirably short life. In addition, the thin, flat, slippery nature of conventional sandpaper makes the article difficult to grasp, hold and maneuver, and does not make sandpaper well suited for sanding curved, contoured, or textured surfaces.

U.S. Pat. No. 5,849,051 (Beardsley et al.) discloses abrasive foam articles comprising a flexible and resilient foam substrate having first and second major substrate surfaces, at least one of the surfaces having a plurality of open cells substantially across the substrate surfaces, the open cells having coatable surfaces defined by interconnected voids; and a plurality of abrasive particles adhered to the coatable surface of the open cells in a substantially uniform manner.

U.S. Pat. No. 6,613,113 (Minick et al.) discloses a flexible abrasive product comprising a flexible sheet-like substrate comprising a multiplicity of separated resilient bodies connected to each other in a generally planar array in a pattern which provides open spaces between adjacent connected bodies, each body having a first surface and an opposite second surface; and abrasive particles to cause at least the first surface to be an abrasive surface.

The industry is always seeking improved conformable flexible abrasive articles that are more durable, are easier to handle and use, have improved cut, produce finer scratches, have a longer life, and can be used with hand sanding blocks. It would be desirable to provide a flexible resilient abrasive article that has improved durability over a wide range of abrasive grit sizes, has improved flexibility, has improved handling and is therefore is easy and comfortable to use, is easy and inexpensive to make, has improved cut, produces finer scratches than a comparable sheet of sandpaper, lasts longer, and can be used with a hand sanding block. In addition, it would be desirable to provide a flexible resilient sheet-like abrasive article in combination with a hand sanding tool.

SUMMARY

The present invention generally provides a flexible resilient sheet-like abrasive article with improved durability over a wide range of abrasive grit sizes, has improved flexibility, has improved handling and is therefore easy and comfortable to use, has improved cut, produces finer scratches than a comparable sheet of sandpaper, is easy and inexpensive to make, lasts longer than other flexible resilient abrasive articles, and/or may be used with a hand sanding block. The expression "sheet-like" as used herein refers generally to the broad, thin, flexible nature of the abrasive article.

In one embodiment, the present invention provides a sheet-like abrasive article including a resilient backing sheet having opposed major surfaces, and a continuous abrasive sheet affixed to at least one surface of the backing sheet. The abrasive sheet includes a continuous abrasive support layer with abrasive particles arranged thereon, thereby defining an abrasive surface.

In more specific aspects, the resilient backing sheet may comprise a continuous closed-cell foam, or may comprise a discontinuous sheet formed by a plurality of separated resilient bodies held together in a pattern so as to provide openings between each adjacent separated body yet connected to one another at contact points. In even more specific aspects, the backing sheet may be formed of a polyvinylchloride foam material, a foamed latex rubber material, or a nonwoven material. The backing sheet may also comprise a conventional tack cloth.

In another specific aspect, the backing sheet generally has a thickness of no greater than about 8 mm, more generally no greater than about 7 mm, and even more generally no greater than about 6 mm.

In yet another aspect, the backing sheet may include a generally flat surface bonded with the abrasive support layer and may further include a textured surface opposite the flat surface defining a gripping surface opposite the abrasive surface which is engaged by the user to manually actuate the abrasive article.

In another aspect, the abrasive support layer may comprise a cloth material. A particular cloth material is a J-weight woven cloth. In a specific embodiment, the abrasive sheet and backing sheet may be adhesively bonded together.

In yet another aspect, the present invention provides a sanding tool assembly including a hand-held, manually-operated sanding tool and a replaceable sheet-like abrasive material such as the sheet-like abrasive material described above. In more specific aspects, the sanding tool may comprise a base member having first and second opposed ends and a generally planar bottom surface extending between the first and second ends, and at least one inclined upper contact surface opposite the bottom surface adjacent one of the first and second ends arranged to form an acute angle with the bottom surface relative to the associated adjacent end, and a clamping mechanism pivotally connected with the base member, the clamping mechanism being movable between an open position wherein the clamping mechanism is spaced from the base member contact surface, thereby defining a gap between the base member upper contact surface and the clamping mechanism for receiving an end portion of the sheet of abrasive material, and a closed position wherein the clamping mechanism is moved toward the contact surface and is arranged adjacent the base member contact surface, the clamping mechanism including a tensioning member arranged to slidably engage the contact surface, whereby when an end portion of the sheet of abrasive material is inserted into the gap between the base member and the clamping mechanism, and the clamping mechanism is moved from the open position to the closed position, the tensioning member engages the sheet of abrasive material, and as the clamping mechanism is further urged toward the contact surface, the tensioning member and abrasive sheet move upwardly along the inclined contact surface away from the associated end, thereby tightening the fit of the abrasive sheet against the bottom surface of the base member.

In other aspects, the tensioning member may comprise a flexible metal leaf spring, and the tensioning member may extend the width of the clamping mechanism. In addition, the tensioning member may include a gripping surface for increasing the frictional force between the tensioning member and the sheet of abrasive material. In one embodiment, the gripping surface may comprise a plurality of the projections Advantages of certain embodiments of the invention include improved durability, providing an abrasive article that has a comfortable gripping surface, providing a simplified design that is easy and less costly to manufacture, providing an abrasive article that has improved cut, improved flexibility, reduced scratch, reduced loading, and the ability to be readily used with a hand sanding block.

BRIEF DESCRIPTION OF THE DRAWINGS

The present invention will be further described with reference to the accompanying drawings, in which.

DETAILED DESCRIPTION

Figure 1:
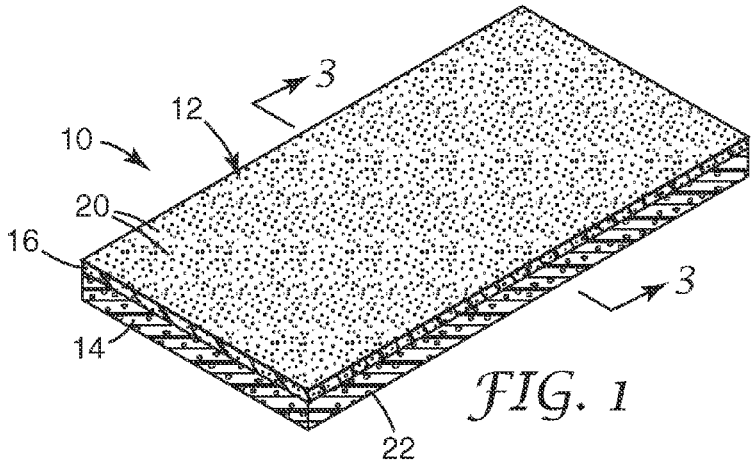
FIG. 1 is a perspective view of a flexible resilient abrasive article according to the invention.
Figure 2:
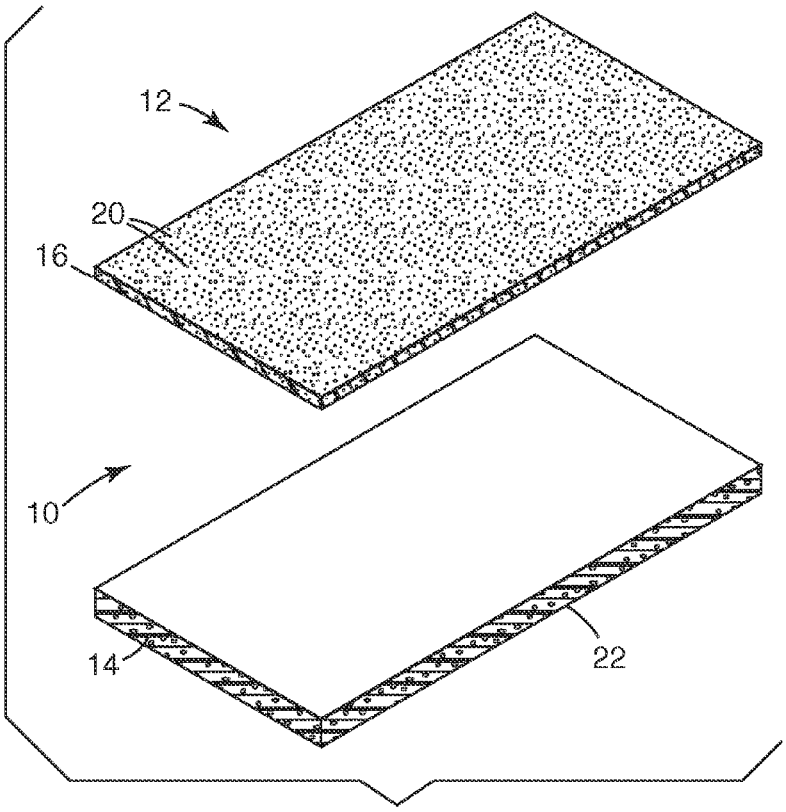
FIG. 2 is an exploded view of the abrasive article of FIG. 1.
Figure 3:
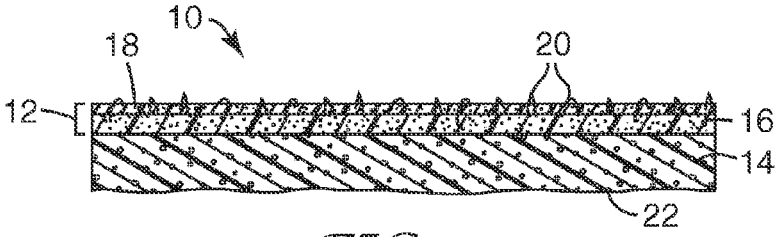
FIG. 3 is a cross-sectional view taken along line 3-3 of FIG. 1.

Referring now to the drawings, wherein like reference numerals refer to like or corresponding features throughout the several views, FIGS. 1-3 show a flexible resilient abrasive article 10 comprising an abrasive sheet 12 and a backing sheet 14. The abrasive sheet 12 includes an abrasive support layer 16 which is affixed to the backing sheet 14, a make coat layer 18 (FIG. 3) on the abrasive support layer 16, and a plurality of abrasive particles 20 at least partially embedded in the make coat layer 18. The abrasive sheet 12, which includes the abrasive support layer 16, the make coat layer 18 and the abrasive particles 20, and the backing sheet 14 are each described in detail below.

Backing Sheet 14

The backing sheet 14 is formed of a durable, resilient, conformable material. The backing sheet 14 provides a comfortable gripping surface for the user and further provides the abrasive article with a degree of conformability, thereby allowing the abrasive article 10 to more effectively sand rough, curved and/or contoured surfaces. In addition, the backing sheet 14 provides support for the abrasive support layer 16, thereby improving the overall durability of the abrasive article 10.

The backing sheet 14 may be formed of any durable resilient material including open-cell foams, closed-cell foams, and reticulated foams, each of which may further include an outer skin layer, natural and synthetic rubber materials, and woven and nonwoven materials. The backing sheet 14 may also comprise a tack cloth such as the tack cloth described in U.S. Pat. No. 6,746,974 (Reiterer), the entire contents of which are hereby incorporated by reference. Suitable materials for a foam backing sheet 14 include, for example, synthetic polymer materials such as polyurethanes, polyvinylchloride (PVC), foam rubbers and latex, and silicones, and natural sponge materials. To enhance the durability of the backing sheet 14, the backing sheet 14 may further include a reinforcing scrim embedded in the foam. In one embodiment of the invention, the backing sheet 14 is formed of a closed-cell foam. Closed-cell foam is desirable because of its toughness and durability.

Figure 6:
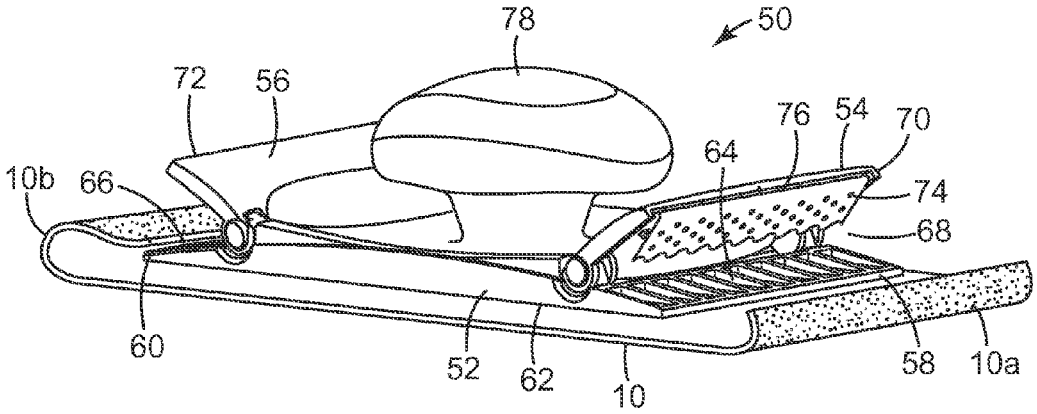
FIG. 6 is a perspective view showing a sanding tool with the resilient abrasive article of FIG. 1 according to another aspect of the invention.

To allow the abrasive article 10 to be used with a hand sanding tool, such as the hand sanding tool 50 shown in FIG. 6 and described in more detail below, the abrasive article 10 is flexible enough so that it can be folded back onto itself, and is thin enough so that opposite end portions of the abrasive article can be inserted into the jaws of a hand sanding block. The thickness of the backing sheet 14 is generally no greater than about 8 mm, more generally no greater than about 7 mm, and even more generally no greater than about 6 mm.

The backing sheet 14 may be continuous or discontinuous. A continuous backing sheet is one that does not contain holes, voids, or channels extending there through in the Z-direction (i.e. the thickness or height dimension) that are larger than the randomly formed spaces between the material itself when it is made. A discontinuous backing sheet, on the other hand, contains openings extending there through in the Z-direction.

Suitable continuous foam materials are available from Voltek, LLC, Lawrence Mass., under the trade name Volextra. These materials are cross-linked, closed-cell, polyolefin foams. Suitable discontinuous foam materials are available under the trade names OMNI-GRIP, MAXI-GRIP, ULTRA GRIP, EIRE-GRIP, and LOC-GRIP from Griptex Industries, Inc. of Calhoun, Ga.

FIGS. 1-3 show an abrasive article 10 with a foam backing sheet 14 having a continuous structure. The exposed (or bottom) surface 22 of the backing sheet 14 (i.e. the surface that is not attached to the abrasive support layer 16), optionally includes a textured, embossed, contoured, or otherwise macroscopically three-dimensional surface topography to enhance a user's ability to grip or hold the abrasive article 10 as it is moved across a work surface.

Figure 4:
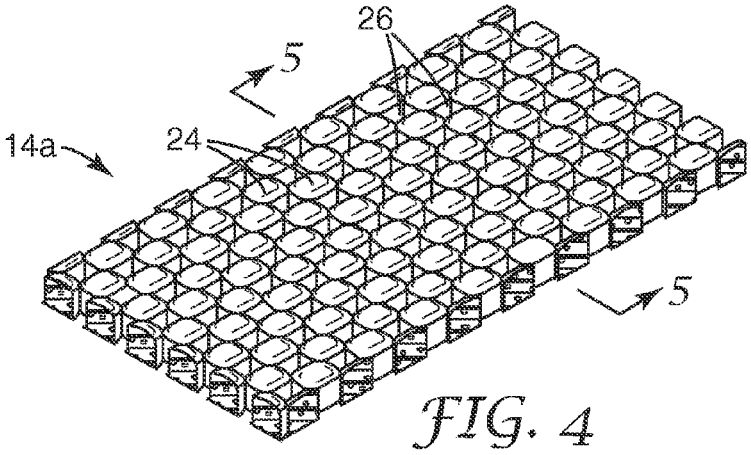
FIG. 4 is a perspective view of an alternate backing sheet.
Figure 5:
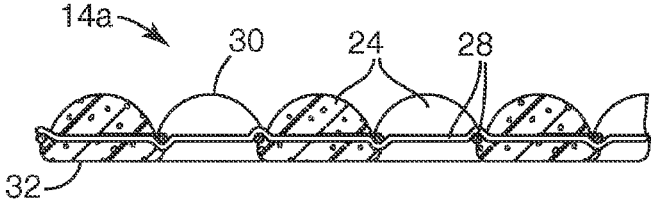
FIG. 5 is a cross-sectional view taken along line 5-5 of FIG. 4.

FIGS. 4 and 5 show an alternate foam backing sheet 14*a* having a discontinuous or open structure. The backing sheet 14*a* is formed of a plurality of separated resilient bodies 24 which are held together in a pattern so as to define openings 26 between each adjacent separated body yet connected to one another at contact points. While such backing sheets may be formed by appropriate die cutting of a continuous or sheet of rubber or foam-like material, the illustrated backing sheet 14*a* includes a scrim 28 including parallel threads and cross-parallel threads typically in a grid pattern which provides openings, every other one of which is closed by a resilient body in an offset pattern.

Each resilient body 24 may include a first surface 30 which is preferably convex or domed, and a second surface 32 which is preferably flat, which allows the backing sheet 14*a* to be more readily attached to the abrasive support layer 16. The collection of first surfaces 30 provides an easily handleable backside of the abrasive article which easily conforms to the hand of a user to provide a convenient deformable product which is easily utilized to abrade surfaces which have a complex shape.

Suitable materials for an open backing sheet 14 such as those described above are commercially available under the trade names OMNI-GRIP, MAXI-GRIP, ULTRA GRIP, EIRE-GRIP, and LOC-GRIP from Griptex Industries, Inc. of Calhoun, Ga. Such products may be made according to U.S. Pat. No. 5,707,903 (Schottenfeld), the entire contents of which are hereby incorporated by reference.

Such materials are generally formed by dipping a scrim into a liquid composition that is curable to form a polyvinylchloride (PVC) foam. The scrim may be made of natural or synthetic fibers which may be either knitted or woven in a network having intermittent openings spaced along the surface of the scrim. The scrim need not be woven in a uniform pattern but may also include a nonwoven random pattern. Thus, the openings may either be in a pattern or randomly spaced. The scrim network openings may be rectangular or they may have other shapes including a diamond shape, a triangular shape, an octagonal shape or a combination of these shapes.

Preferably the scrim comprises a first set of rows of separated fibers deployed in a first direction and a second set of fibers deployed in a second direction to provide a grid including multiple adjacent openings wherein resilient bodies are located in alternate openings with openings between resilient bodies being devoid of resilient bodies. The scrim may also comprise an open mesh selected from the group consisting of woven or knitted fiber mesh, synthetic fiber mesh, natural fiber mesh, metal fiber mesh, molded thermoplastic polymer mesh, molded thermoset polymer mesh, perforated sheet materials, slit and stretched sheet materials and combinations thereof.

The composition of the resilient bodies may either be foamed or non-foamed, and may be composed of any of a variety of elastomeric materials including, but not limited to, polyurethane resins, polyvinyl chloride resins, ethylene vinyl acetate resins, synthetic or natural rubber compositions, acrylate resins and other suitable elastomeric resin compositions.

Such backing sheets are characterized by having open areas between resilient bodies to provide cumulative open areas as compared to the total area of the resilient body on the order of about 20% to about 80%, more preferably, between about 30% to about 60%.

The backing sheet 14*a* has a sufficient thickness to make it convenient for being hand-held and to provide a comfortable grip, but is thin enough to allow it to be folded back onto itself to and thin enough to allow it to be inserted into the jaws of a manually operated hand sanding tool. The thickness is measured between the highest point of the first surface of the resilient body to the second surface of the resilient body. The minimum thickness is typically at least about 1 mm, more typically at least about 2 mm, and even more typically, at least about 3 mm. The maximum thickness is typically less than about 8 mm, more typically less than about 7 mm, and even more typically less than about 6 mm.

While a square or rectangular shape (as viewed from the top or bottom of the sheet) of the resilient body is preferred, the bodies may be any convenient geometric shape including, but not limited to, square, rectangular, triangular, circular, and in the shape of a polygon. The resilient bodies are preferably uniform in shape, but they need not be. The resilient bodies may be aligned in rows longitudinally and in a transverse direction but for some applications it may be preferable that they not be aligned because in sanding operations where the abrasive product is moved in only one direction, for example, the longitudinal direction, longitudinally aligned abrasive covered resilient bodies could produce an unwanted scratch pattern in the surface being abraded.

The dimensions of the resilient bodies 24 may vary from about 2 to about 25 mm, preferably from 5 to 10 mm. "Each dimension" refers to the dimension of a side, if rectangular, the diameter, if circular, or the maximum dimension if of an irregular shape. The shapes of the resilient bodies 24 need not be a defined shape but may be randomly shaped. When referring to the dimensions of the resilient body, the dimensions are intended to include the widths in the longitudinal or transverse direction or the maximum dimension of the body when measured from one side to the other notwithstanding any direction.

The openings 26 in the backing sheet 14*a* are generally individually smaller than the adjacent resilient body 24 and may have dimensions on the order of about 2 mm to about 25 mm, preferably of about 5 mm to about 10 mm. The openings 26 may be somewhat rectangular, if the resilient bodies 24 are rectangular, or the openings 26 may take any other configuration depending on the shape of the adjacent resilient bodies 24. The shape of the openings 26 is typically defined by the shape of the edges of the resilient bodies 24. The resilient bodies 24 and the openings 26 are generally uniformly distributed throughout the entire area of the flexible abrasive article of the invention but this is not necessary in all cases.

Abrasive Support Layer 16

The abrasive support layer 16 may be formed from a variety of commonly available materials including, for example, paper, knitted or woven fabric materials or cloth, fibrous nonwoven webs, polymeric films such as a thermoplastic film, and foam materials or laminates thereof. The particular abrasive support layer will have sufficient strength for handling during processing, sufficient strength to be used for the intended end use application, the ability to have the make coat 18 transferred to at least one of its major surfaces, and is able to be affixed to the backing sheet 14. The abrasive support layer 16 may be adhesively bonded to the backing sheet 14 using, for example, a pressure-sensitive adhesive, a hot melt adhesive, a thermosetting adhesive, by flame bonding, or by other known techniques including lamination using heat and pressure.

In accordance with one aspect of the invention, the abrasive support layer 16 is continuous. That is, the abrasive support layer 16 does not contain holes, openings, slits, voids, or channels extending there through in the Z-direction (i.e. the thickness or height dimension) that are larger than the randomly formed spaces between the material itself when it is made. The abrasive support layer 16 is also generally non-extensible. Non-extensible refers to a material having an elongation at break of typically no greater than about 25%, and even more typically, no greater than about 10%. In addition, the abrasive support layer 16 is relatively thin compared to the thickness of the backing sheet 14. In one embodiment, for example, the abrasive support layer 16 typically has a thickness of no greater than about 1.5 mm, and more typically no greater than about 1 mm, and accounts for no greater than about 25% of the overall thickness of the abrasive article 10. In addition, the abrasive support layer 16 is generally not resilient, and may be porous or non-porous.

In a preferred aspect of the invention, the abrasive support layer 16 is a cloth material. Cloth materials are desirable because they are generally tear resistant and are more durable than paper and film materials. In addition, cloth backings tolerate repeated bending and flexing during use. Cloth backings are generally formed of woven cotton or synthetic yarns that are treated to make them suitable for use as a coated abrasive backing. A suitable cloth backing is a J-weight cloth backing.

Make Coat 18

In general, any make coat 18 may be used to adhere the abrasive particles 20 to the abrasive support layer 16. "Make coat" refers to the layer of hardened resin over the abrasive support layer 16 of the abrasive article 10. A preferred make coat is a phenolic resin. The make coat 18 may be coated onto the abrasive support layer 16 by any conventional technique, such as knife coating, spray coating, roll coating, rotogravure coating, curtain coating, and the like. The abrasive article 10 may also include an optional size coat.

Abrasive Particles 20

In general, any abrasive particles may be used with this invention. Suitable abrasive particles include fused aluminum oxide, heat treated aluminum oxide, alumina-based ceramics, silicon carbide, zirconia, alumina-zirconia, garnet, diamond, ceria, cubic boron nitride, ground glass, quartz, titanium diboride, sol gel abrasives and combinations thereof. The abrasive particles can be either shaped (e.g., rod, triangle, or pyramid) or unshaped (i.e., irregular). The term "abrasive particle" encompasses abrasive grains, agglomerates, or multi-grain abrasive granules. The abrasive particles can be deposited onto the make coat by any conventional technique such as electrostatic coating or drop coating.

It will be recognized that the abrasive support layer 16, the abrasive particles 20, and make coat 18 may be provided in the form of a pre-formed (i.e., commercially available) abrasive sheet. That is, rather than providing an abrasive support layer 16, coating the abrasive support layer 16 with make coat 18, and depositing abrasive particles 20 on the make coat 18 to form an abrasive sheet, a finished abrasive sheet including a backing, make coat and abrasive particles may be provided. A suitable abrasive sheet is available under the product designation 900DZ-REG, from 3M Company, St. Paul, Minn. 900DZ-REG is an abrasive sheet having a J weight cloth backing, a phenolic make coat, and ceramic abrasive particles.

Additives

The make coat and/or the optional size coat may contain optional additives, such as fillers, fibers, lubricants, grinding aids, wetting agents, thickening agents, anti-loading agents, surfactants, pigments, dyes, coupling agents, photoinitiators, plasticizers, suspending agents, antistatic agents, and the like. Possible fillers include calcium carbonate, calcium oxide, calcium metasilicate, alumina trihydrate, cryolite, magnesia, kaolin, quartz, and glass. Fillers that can function as grinding aids include cryolite, potassium fluoroborate, feldspar, and sulfur. The amounts of these materials are selected to provide the properties desired, as known to those skilled in the art.

General Method of Making

The abrasive article 10 shown in FIGS. 1-3 may be made by first forming an abrasive sheet 12 including an abrasive support layer 16, a make coat 18, and abrasive particles 20. This may be accomplished by either providing a backing, coating it with make coat and depositing abrasive particles on the make coat, or by providing a finished abrasive sheet 12 including a backing, make coat and abrasive particles, such as the product available from 3M Company, St. Paul, Minn. under the product description DZ900-REG, described above.

An adhesive, such as a pressure-sensitive adhesive, may then applied to the back of the abrasive support layer 16 (i.e., to the side opposite the surface coated with abrasive particles 20), thereby serving to bond the abrasive sheet 12 to the backing sheet 14. The adhesively coated abrasive sheet 12 may then be adhesively bonded to the backing sheet 14. The completed abrasive article may then be cut to the desired size and/or size.

Sanding Tool 50

In accordance with another aspect of the invention, the sheet-like abrasive article 10 may be used with a hand-held, manually-operated sanding tool or sanding block, thereby forming a sanding tool assembly including a tool and a replaceable sheet-like abrasive article. FIG. 6 shows a hand-held, manually-operated sanding tool or sanding block 50 for use with the flexible, replaceable, sheet-like abrasive article 10 described above. The term "manually-operated" refers to the fact that the tool 50 is not a power tool. That is, all of the power for the tool is provided by the user and the tool itself does not include a motor. It will be recognized, however, that the present invention may also include power tools.

The sanding tool 50 includes a base member 52 and a pair of clamping mechanisms 54, 56 connected with opposed ends of the base member 52. Although the sanding tool 50 is shown with clamping mechanisms 54, 56 at both ends, it will be recognized that one of the clamping mechanisms 54, 56 may be replaced with a conventional mechanism for securing the abrasive sheet-like article 10 to the tool. It will also be recognized that although the base member 52 is shown as being rectangular, it may also be square or other shapes that lend themselves for use with sheet-like abrasives.

The base member 52 has first 58 and second 60 opposed ends and a generally planar bottom surface 62 against which the sheet-like abrasive article 10 is secured. Each end 58, 60 of the base member 52 has an inclined or angled contact surface 64, 66, respectively, opposite the bottom surface 62. In this manner, the contact surfaces 64, 66 and bottom surface 62 form an acute angle relative to the associated adjacent end 58, 60, respectively.

Each clamping mechanism 54, 56 is pivotally connected with opposite ends 58, 60 of the base member 52 adjacent the contact surface 64, 66, respectively, thereby defining a jaw into which the end portions 10*a*, 10*b* of the sheet-like abrasive article 10 may be inserted. Each clamping mechanism 54, 56 is movable between an open position (as shown in FIG. 6) and a closed position (not shown). In the open position, the clamping mechanisms 54, 56 are spaced from the associated contact surface 64, 66, thereby defining a gap 68 between the base member 52 contact surface 64, 66 and the clamping mechanism 54, 56. The gap 68 is sized to receive the end portions 10*a*, 10*b* of the sheet-like abrasive article 10 which typically have a thickness of less than about 10 millimeters (mm), more typically, about 0.1 mm to about 8 mm, and even more typically about 0.5 mm to about 5 mm. In the closed position, the clamping mechanisms 54, 56 are moved toward the associated contact surfaces 64, 66, respectively, and, when no abrasive article is present, are arranged adjacent to the contact surfaces 64, 66, respectively.

Each clamping mechanism 54, 56 includes a pivoting member 70, 72 pivotally connected with the base member 52 and a flexible tensioning member 74 arranged on the under side of each pivoting member 70, 72 so that it faces the associated contact surface 64, 66. Arranged in this manner, as the clamping mechanisms 54, 56 are lowered toward the base member 52 to secure the abrasive article 10 to the tool 50, the terminal edge of the tensioning member 74 slidably engages the associated contact surface 64. Thus, when an end portion 10*a*, 10*b* of an abrasive article 10 is inserted in the gap 68 between the base member 52 and a clamping mechanism 54, 56, and the clamping mechanism is moved from its open position to the closed position, the edge of the tensioning member 74 will frictionally engage the end portion 10*a*, 10*b* of the abrasive article 10.

As the clamping mechanisms 54, 56 are further urged toward the contact surfaces 64, 66, the tensioning member 74 grips the end portion of the abrasive article 10*a* and moves it upwardly along the inclined contact surfaces 64, 66 away from the associated end 58, thereby drawing the abrasive sheet 12 farther into the gap 68. In addition, as the clamping mechanisms 54, 56 are urged against the contact surfaces 64, 66, the tensioning member 74 tends to bow or flex such that the bowed surface of the tensioning member 74 will engage the contact surfaces 64, thereby increasing the overall contact surface area between the tensioning member 74 and the abrasive article 10. In this manner, slack in the abrasive article 10 is taken up, thereby tightening the fit of the abrasive article 10 against the bottom 62 of the base member 52.

In the illustrated embodiment, the tensioning member 74 is a thin flexible strip of metal, such as a leaf spring, that generally returns to its original position when the applied force is released. Other materials such as a stiff resilient rubber or synthetic plastic material may also be used. To distribute the force applied by the tensioning member 74 to the end portion of the abrasive article 10*a* evenly (both during the installation of the abrasive article 10 onto the tool and while the abrasive sheet is being held onto the tool), the tensioning member 74 preferably extends continuously across substantially the entire width of the associated clamping mechanism 54. By distributing the force in this manner, the tensioning member 74 has a reduced tendency to tear or otherwise damage the abrasive article 10.

To further reduce the likelihood that the ends of the tensioning member 74 will dig into the abrasive article 10, and thereby possibly damage the abrasive sheet, in an alternative embodiment, the tensioning member 74 may be curved or bowed inwardly such that the tensioning member 74 has a curved surface that faces the contact surface 64, and engages the contact surface when the clamping mechanism 54 is closed.

To improve the holding and retaining capability of the tensioning member 74, the tensioning member 74 may include an optional wavy terminal edge. Other shapes for the terminal edge are contemplated in connection with the present invention. For example, the terminal edge may be serrated, notched, or ridged. In addition, the tensioning member 74 may be formed with separate flexible fingers that can individually flex to better accommodate rough or contoured surfaces. The flexible fingers may also include a shaped terminal edge.

To increase the coefficient of friction between the tensioning member 74 and the abrasive article 10, and thereby improve the ability of the tensioning member 74 to firmly grip and retain the abrasive article 10 (and therefore securely hold the abrasive article 10 both as the abrasive article 10 is installed on the tool and during use after the abrasive article is installed on the tool 50), the tensioning member 74 may optionally include a gripping surface 76. In the illustrated embodiment, the gripping surface 76 comprises a plurality of projections. Alternatively, the gripping surface 76 may comprise, for example, a smooth pliable surface formed of, for example, rubber.

The tool 50 includes a handle 78 extending upwardly from a central region of the base member 52. The handle 78 includes a head portion that defines a knob that can be readily grasped by a user to maneuver and control the movement of the tool 50.

In order that the invention described herein can be more fully understood, the following example is set forth. It should be understood that this example is for illustrative purposes only, and is not to be construed as limiting this invention in any manner.

Persons of ordinary skill in the art may appreciate that various changes and modifications may be made to the invention described above without deviating from the inventive concept. Thus, the scope of the present invention should not be limited to the structures described in this application, but only by the structures described by the language of the claims and the equivalents of those structures.

What is claimed is:

1. A flexible sheet-like abrasive article for hand-held, manually-operated sanding, consisting of:

a flexible continuous single layer backing sheet that is a polymeric foam material and that has opposed first and second major surfaces; and, a flexible continuous abrasive sheet that includes a flexible continuous abrasive support layer chosen from the group consisting of paper and cloth and having first and second major surfaces, with abrasive particles deposited on the first major surface and adhered to the first major surface of the abrasive support layer by a make coat resin that is in the form of a make coat layer that is not the same layer as the abrasive support layer and that is coated onto the abrasive support layer, thereby defining an abrasive surface comprising protruding abrasive particles, wherein the first major surface of the backing sheet has a generally flat surface that is adhesively bonded to the second major surface of the abrasive support layer, and wherein the entirety of the second major surface of the backing sheet is a textured gripping surface which is engaged by the hand of a user to manually actuate the flexible sheet-like abrasive article.

2. An abrasive article as defined in claim 1, wherein the flexible continuous backing sheet has a thickness of no greater than about 6 mm.

3. An abrasive article as defined in claim 1, wherein the flexible continuous backing sheet has a thickness of at least about 1 mm.

4. An abrasive article as defined in claim 1, wherein the abrasive support layer has a thickness of no greater than about 1 mm and accounts for no greater than about 25% of the overall thickness of the abrasive article.

5. An abrasive article as defined in claim 1, wherein the textured surface of the second major surface of the flexible continuous backing sheet is an embossed surface.

6. An abrasive article as defined in claim 1, wherein the foam material is a closed cell foam.

7. An abrasive article as defined in claim 1, wherein the foam material is chosen from the group consisting of polyurethane, PVC, silicone, foam rubber, and latex.

8. An abrasive article as defined in claim 1, wherein the foam material is a natural or synthetic rubber material.

9. An abrasive article as defined in claim 1, wherein the bonding adhesive that is used to bond the first major surface of the backing sheet to the second major surface of the abrasive support layer is chosen from the group consisting of a pressure-sensitive adhesive, a hot melt adhesive, and a thermosetting adhesive.

10. An abrasive article as defined in claim 1, wherein the abrasive support layer is a J-weight woven cloth.

11. A method of sanding a work surface by hand, comprising:

providing a flexible sheet-like abrasive article consisting of:

a flexible continuous single layer backing sheet that is a polymeric foam material and that has opposed first and second major surfaces; and, a flexible continuous abrasive sheet that includes a flexible continuous abrasive support layer chosen from the group consisting of paper and cloth and having first and second major surfaces, with abrasive particles deposited on the first major surface and adhered to the first major surface of the abrasive support layer by a make coat resin that is in the form of a make coat layer that is not the same layer as the abrasive support layer and that is coated onto the abrasive support layer, thereby defining an abrasive surface comprising protruding abrasive particles, wherein the first major surface of the backing sheet has a generally flat surface that is adhesively bonded to the second major surface of the abrasive support layer, and wherein the entirety of the second major surface of the backing sheet is a textured gripping surface; and, engaging the textured gripping surface by hand and manually actuating the flexible sheet-like abrasive article across the work surface.

* * * * *